US006471473B1

(12) United States Patent
Wilkinson et al.

(10) Patent No.: US 6,471,473 B1
(45) Date of Patent: Oct. 29, 2002

(54) MARINE IN BILGE BLOWER

(75) Inventors: Bruce Wilkinson, Gloucester; Richard Lord, Beverly; Scott K. Batchelder, Newbury, all of MA (US)

(73) Assignee: Rule Industries, Inc., Glocester, MA (US)

( * ) Notice: Subject to any disclaimer, the term of this patent is extended or adjusted under 35 U.S.C. 154(b) by 0 days.

(21) Appl. No.: 09/688,878

(22) Filed: Oct. 17, 2000

(51) Int. Cl.[7] ..... F03B 10/02

(52) U.S. Cl. ..... 415/182.1; 415/220; 415/213.1; 415/232

(58) Field of Search ..... 415/220, 222, 415/211.2, 213.1, 214.1, 232

(56) References Cited

U.S. PATENT DOCUMENTS

| | | | | |
|---|---|---|---|---|
| 1,061,672 A | * | 5/1913 | Hodgkindon | 415/213.1 X |
| 1,118,739 A | * | 11/1914 | Carter | 415/213.1 X |
| 3,173,605 A | * | 3/1965 | Harris | 415/218.1 |
| 3,491,696 A | * | 1/1970 | Howard | 415/214.1 X |
| 3,891,345 A | * | 6/1975 | Doolin | 415/213.1 X |
| 3,891,355 A | * | 6/1975 | Hecht et al. | 415/220 X |
| 3,976,393 A | * | 8/1976 | Larson | 415/220 X |
| 4,135,253 A | * | 1/1979 | Reich et al. | 415/112 X |
| 4,433,825 A | | 2/1984 | Dernedde et al. | |
| 4,657,483 A | * | 4/1987 | Bede | 415/210.1 X |
| 4,786,085 A | | 11/1988 | Sauer et al. | |
| 4,871,294 A | | 10/1989 | Ivanov et al. | |
| 4,895,489 A | * | 1/1990 | Kohama et al. | 415/218.1 |
| 5,040,943 A | * | 8/1991 | Dwyer et al. | 415/182.1 X |
| D342,075 S | | 12/1993 | Whitley, II | |
| 5,470,200 A | | 11/1995 | Tupov et al. | |
| 5,486,086 A | * | 1/1996 | Bellia et al. | 415/9 |
| 5,551,841 A | | 9/1996 | Kamada | |
| 5,605,438 A | * | 2/1997 | Burdgick et al. | 415/182.1 |
| 5,615,999 A | | 4/1997 | Sukup | |
| 5,616,974 A | | 4/1997 | Yamada | |
| 5,737,913 A | * | 4/1998 | Terry | 415/214.1 X |
| 6,045,327 A | | 4/2000 | Amr | |

FOREIGN PATENT DOCUMENTS

| | | |
|---|---|---|
| GB | 492645 | 9/1938 |
| GB | 2 327 466 A | 1/1999 |
| GB | 0124529 | 6/2002 |

* cited by examiner

*Primary Examiner*—John E. Ryznic
(74) *Attorney, Agent, or Firm*—Dickstein Shapiro Morin & Oshinsky LLP

(57) ABSTRACT

A marine in line bilge blower and a method of manufacturing same are described. The blower, or fan, includes a housing in which a motor, airfoils, a fan wheel hub, and straightening vanes are positioned. Specifically, numerous airfoils are positioned on a fan wheel hub, which is in connection with a motor. The motor is mounted on one of several straightening vanes. The housing includes a base with a pair of feet. To protect the circumference of the housing from physical and thermal stress, strengthening rings are positioned on the circumference.

25 Claims, 6 Drawing Sheets

MARINE IN BILGE BLOWER

BACKGROUND

The invention relates generally to an exhaust fan and more particularly to an axial-flow exhaust fan for use as a bilge blower in marine environments.

Two industrial forms of fans or blowers predominate, axial-flow fans and centrifugal, or radial-flow, fans. In centrifugal fans, air flows through the fan wheel in a mostly radially outward direction, while air flows in an axial-flow fan in an axial direction with almost no radial component.

Axial-flow fans operate by deflecting axially directed air on airfoils, or blades. This deflection causes the air flow to take on a helical flow pattern past the airfoils. This flow shape has two flow components, tangential velocity and axial velocity. Of the two flow components, the axial velocity is the more important component for moving air through the fan. Guide vanes positioned either upstream or downstream of the airfoils serve to translate the tangential velocity component of the air flow into the axial velocity component.

There are two methodologies for determining the size, dimensions, and number and positioning of blades for an axial-flow fan. One method is testing a first axial-flow fan design to ascertain the air volume and static pressure of the fan. Rarely does a first design meet the desired running parameters, and thus redesigning one or more times becomes necessary. Redesigning costs man-hours, and often the result is a fan which is larger than originally anticipated that runs at higher speeds and consumes more brake horsepower than needed. In addition, redesigning often leads to uneven and turbulent air flow and to the creation of stalling effects in certain parts of the blades.

A second methodology, which improves over the first methodology, is to design the axial-flow fan based upon desired outcome parameters as well as desired structural and design parameters. Such parameters may include high efficiency and low sound output over a wide range of operation, non-overloading brake horsepower, a steep pressure curve (little variation in air delivery), a large free delivery of air, large pressure safety margin, and compactness.

One problem experienced with conventional axial fans used in marine environments is that the fan housings are subjected to physical and thermal stresses which may alter the diameter of the housings.

SUMMARY

The invention provides an axial-flow fan which includes a plurality of airfoils extending from a rotatable fan wheel hub, a motor engaged with the fan wheel hub through a shaft, and a housing into which the fan wheel hub and the motor are positioned. The housing has a circumference with a diameter and at least one supporting element surrounding the circumference of the housing. The supporting element inhibits variation in the diameter of the circumference of the housing.

The invention further provides a method of manufacturing an axial-flow fan. The method includes the steps of engaging a fan wheel hub with a motor through a shaft, mounting at least one straightening vane from an inner surface of a housing, positioning the fan wheel hub and the motor within the housing such that the motor is mounted on one of the straightening vanes, and surrounding the housing with at least one supporting element which inhibits variation in the diameter of the circumference of the housing.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF PREFERRED EMBODIMENTS

Figure 1:
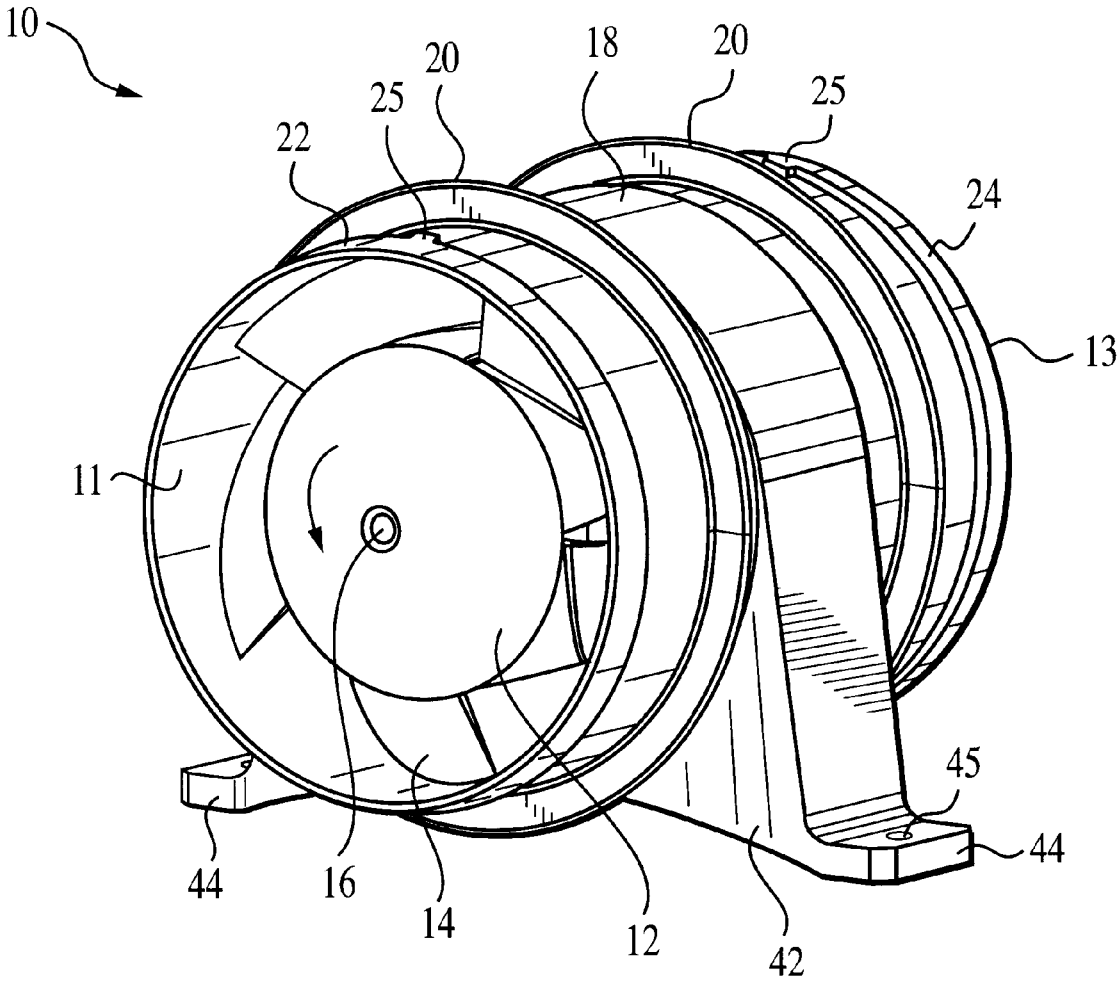
FIG. 1 is a perspective view of an axial-flow fan constructed in accordance with an embodiment of the invention.
Figure 2:
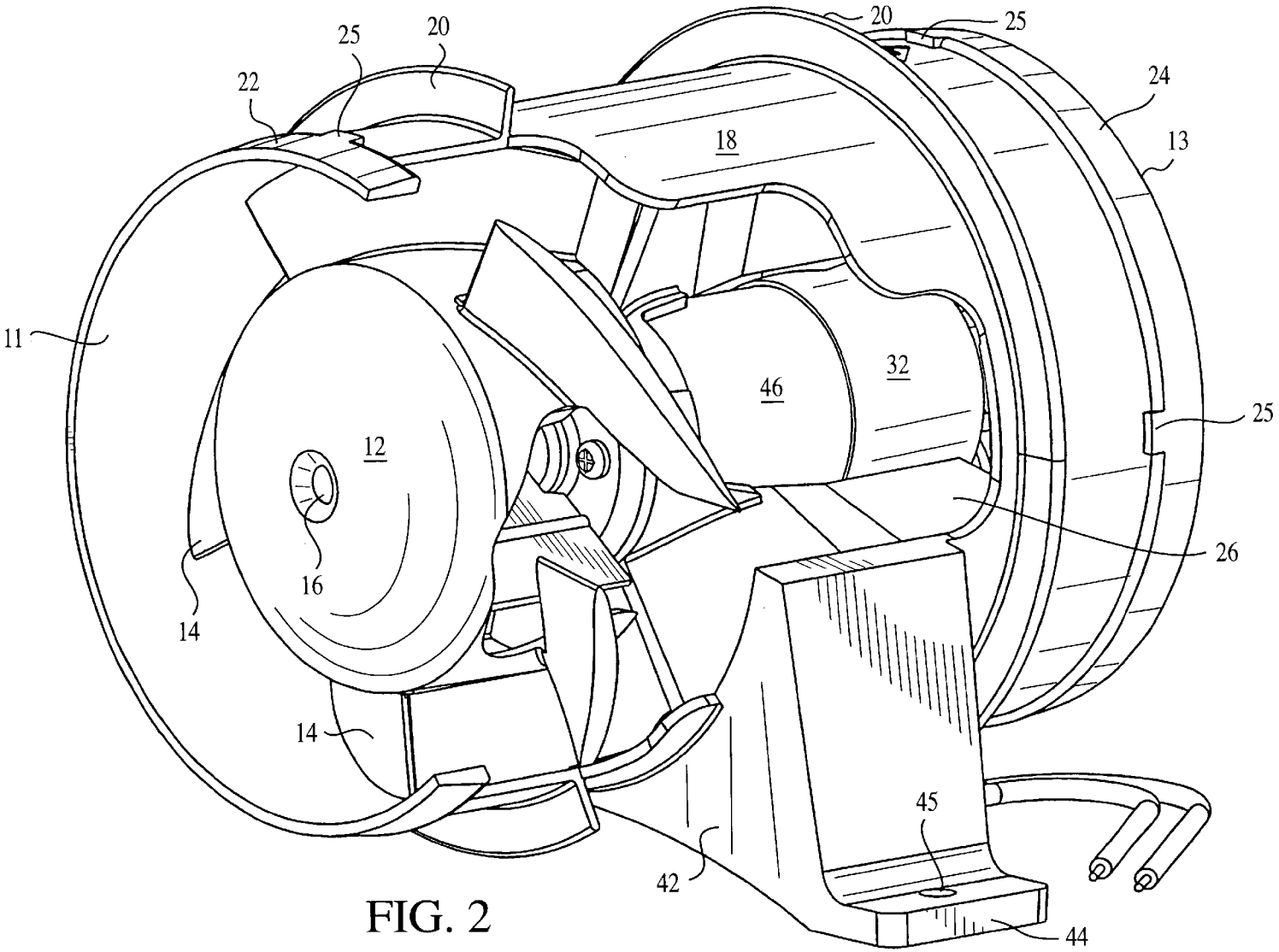
FIG. 2 is a partial cross-sectional view of the fan of FIG. 1.
Figure 3:
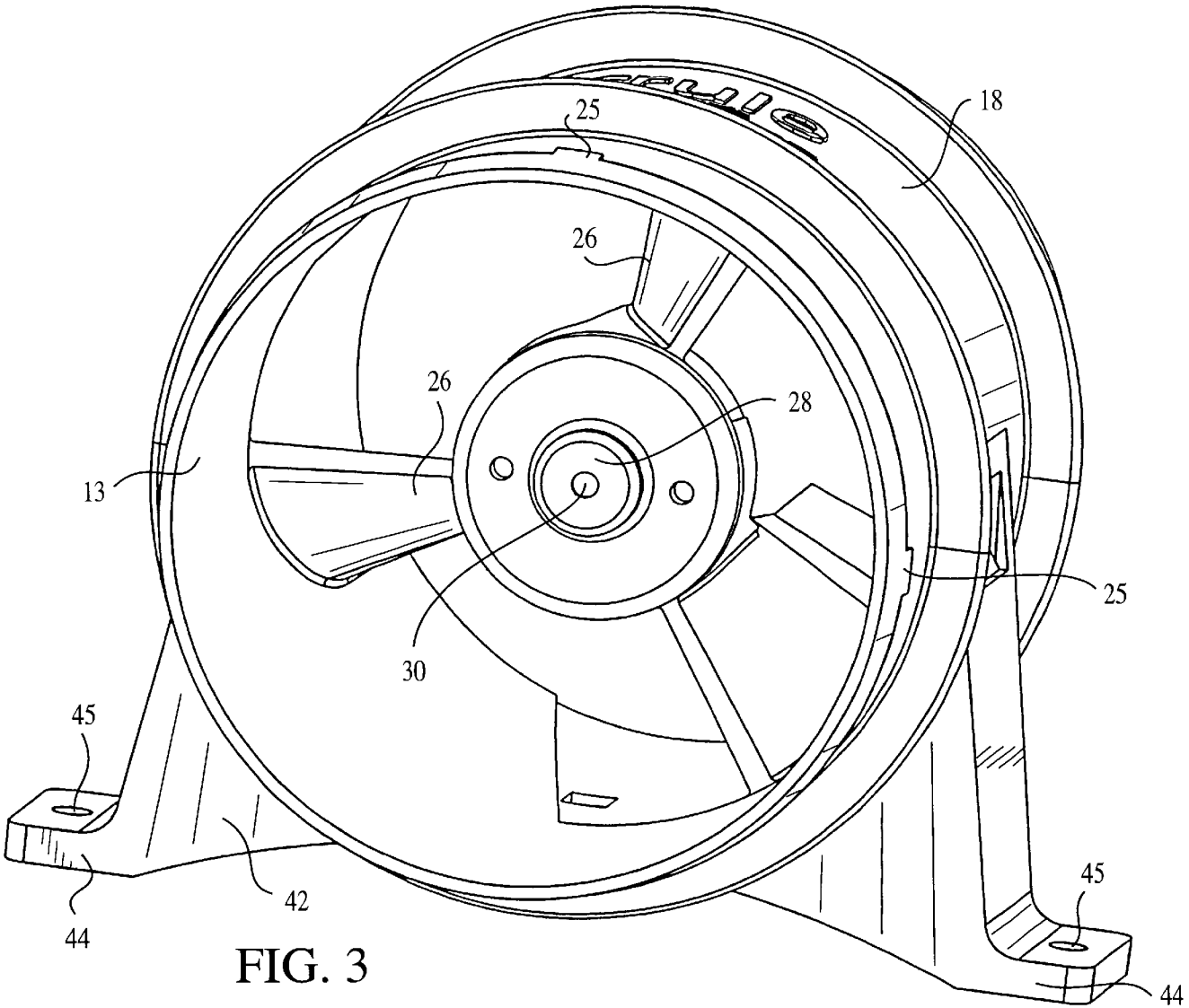
FIG. 3 is another perspective view of the fan of FIG. 1.

FIGS. 1–5 illustrate an axial-flow fan 10 constructed according to a preferred embodiment of the invention. The fan 10 includes a housing 18 extending from a first end 11 to a second end 13. Positioned within the housing 18 between the ends 11, 13 is a fan apparatus which includes a fan wheel hub 12. A plurality of airfoils 14 extend from the hub 12 leaving a small space between the inner surface of the housing 18 and the farthest extent of the airfoils 14. The airfoils 14 are designed similarly to wings on an airplane, wherein the side of the airfoils 14 facing the inlet end 11 has a greater surface area than the side of the airfoils 14 facing the outlet end 13.

The diameter of the hub 12 is chosen to maximize the airflow through the fan 10. Hubs having a smaller diameter relative to the diameter of the housing experience greater turbulence, especially at or near the midpoint of the housing. As the diameter of a hub, such as the hub 12, increases, the amount of turbulence experienced diminishes. For a housing 18 inside diameter of four inches, preferably the hub 12 diameter is two and one-half inches. For a three inch diameter housing 18, the hub 12 diameter is preferably two inches.

The hub 12 is physically connected to a motor 46 through one end of a motor shaft 47. Located between the hub 12 and the end 13 are one or more straightening vanes 26 extending from an inner surface of the housing 18. The motor 46, which is mounted to one of the straightening vanes 26, drives the hub 12, via the shaft 47, causing the hub 12 to rotate. The rotation of the airfoils 14 draws air into the fan apparatus through end 11. As the air is drawn over the airfoils 14, it takes on a corkscrew shape due to the tangential velocity component. As the air continues to be drawn through the vanes 26, the tangential velocity component is translated into an axial velocity component by the curvature of the vanes 26. Through this design, the fan 10 moves more air in a more efficient manner in that it draws less current and is quieter.

The dimensions and number of the airfoils 14 and straightening vanes 26 may be determined by an algorithm for optimizing the performance of the fan 10. The algorithm is available in Bleier, Frank P., *FAN HANDBOOK Selection, Application, and Design* (1998).

The diameter of the housing 18 should remain relatively constant and not vary. For example, since the fan 10 has been designed based on various desired output parameters, a change in the diameter of the housing 18 or its profile may affect the output parameters. Further, if the diameter of the housing 18 is made smaller where the airfoils 14 are located, the airfoils 14 may strike the inner surface of the housing 18 during rotation, most likely leading to premature wear of the airfoils 14 and certainly leading to decreased efficiency of the fan.

One or more strengthening portions, such as, for example, stiffening rings 20 are placed around the circumference of the housing 18 to provide support for the housing and to serve as a positive stop for positioning and mounting ventilation hoses (described below). Preferably, at least one of the rings 20 is provided on the circumference of the housing 18 surrounding the airfoils 14. With this added strength, the housing 18 is better able to remain in its intended shape and is more resistant to physical and/or thermal forces, such as caused by clamping hoses on the ends 11, 13, which may tend to warp or misshape the housing 18. In addition, the stiffening rings 20 provide a positive stop along the circumference of the housing 18 for positioning hoses placed over either end of the fan 10.

A tapered collar 22 is located at the end 11, and another tapered collar 24 is located at the end 13. The tapered collars 22, 24 each include one or more collar tabs 25. The collar tabs 25 assist in attaching the hoses 38, 40 to the collars 22, 24 by extending radially higher than the collars 22, 24. The tabs 25 do not extend around the circumference of the fan housing 18. If the tabs 25 did extend around the circumference, their added height would render impossible attempts to attach the hoses 38, 40 to the collars 22, 24.

A dimple 16 is provided on the hub 12. The dimple 16 is sized and configured to mate with an assembly fixture (not shown) during assembly of the fan 10. Specifically, the dimple 16 ensures proper alignment of the hub 12 with the motor 46 through the shaft 47.

Marine environments are prone to the effects of moisture. Moisture can lead to corrosion, and so it is important to minimize the amount of moisture contacting the motor 46 and the shaft 47. Only one of the ends of the shaft 47 is protected from the moisture. The first end of the shaft 47 is attached to the hub 12. The shaft 47 extends from the hub, through a shaft pocket 30 of a sealing chamber 28 (FIG. 3) located in a back side of the fan wheel hub 12, and into the motor 46. Preferably, an elastomeric washer is placed over the first end, and some grease is applied to the first end, which is then fitted snuggly into the shaft pocket 30. Nonetheless, a portion of the shaft 47 near the first end remains exposed.

Figure 4:
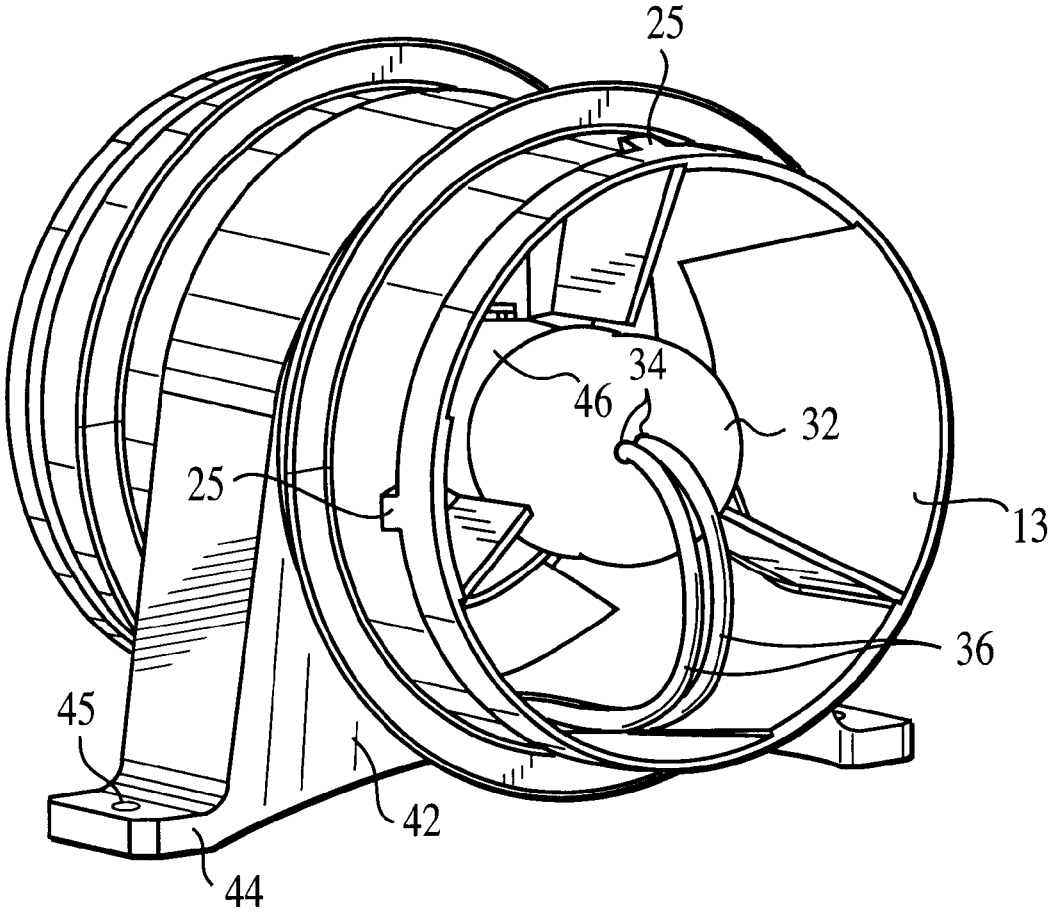
FIG. 4 is another perspective view of the fan of FIG. 1.
Figure 5:
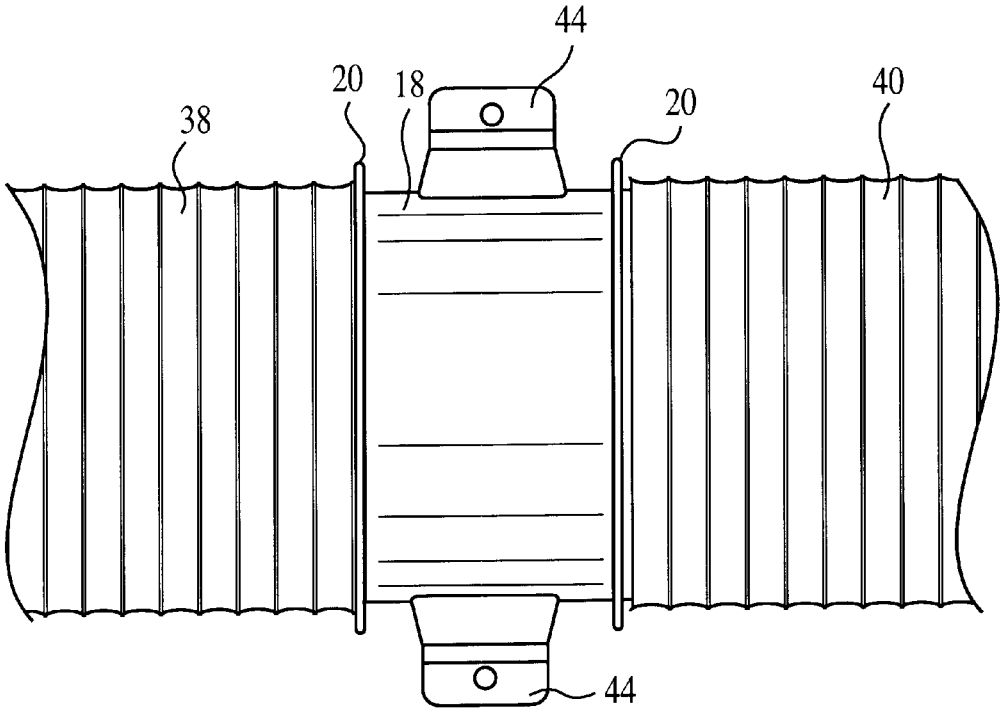
FIG. 5 is a top view of the fan of FIG. 1 coupled with a pair of ventilation hoses.
Figure 6:
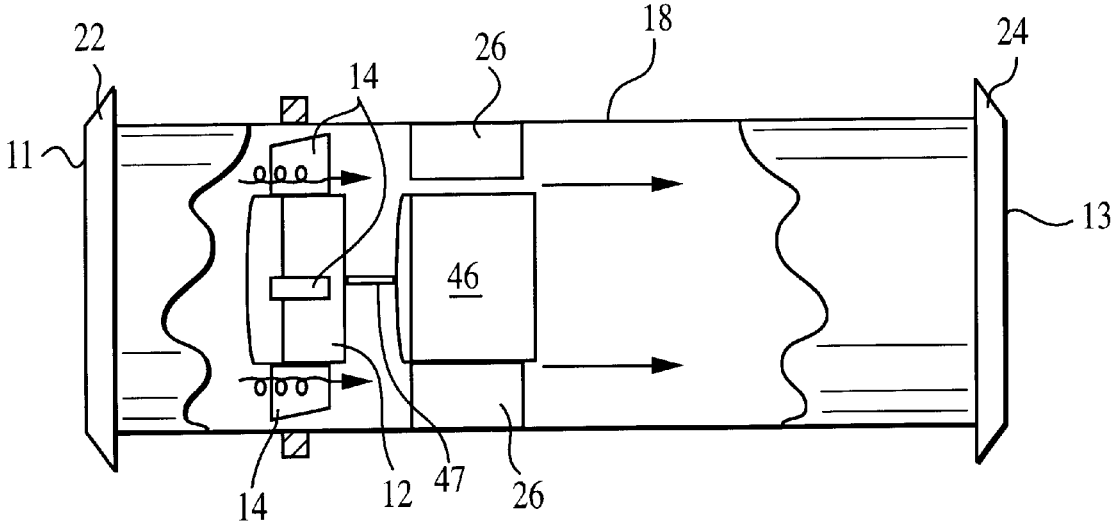
FIG. 6 is a partial cross-sectional view showing the interior of the fan of FIG. 1.

A second end of the shaft 47 is protected from moisture by a protective boot 32 (FIG. 4). The boot 32, which is preferably formed of vinyl, covers the second end of the shaft 47 coming from the motor 46. Openings 34 are created in the boot 32 to allow for a pair of wires 36 to be squeezed out. The motor 46 is also protected from moisture by a spray coating of a protectant, such as, for example, dichromate.

The entire housing 18 is supported on a hollow base 42 having a pair of feet 44. The feet 44 each contain an opening 45 which may be utilized to attach the fan 10 to some base substrate (not shown). The hollowness of the base 42 adds strength while lessening weight of the fan 10.

Figure 7:
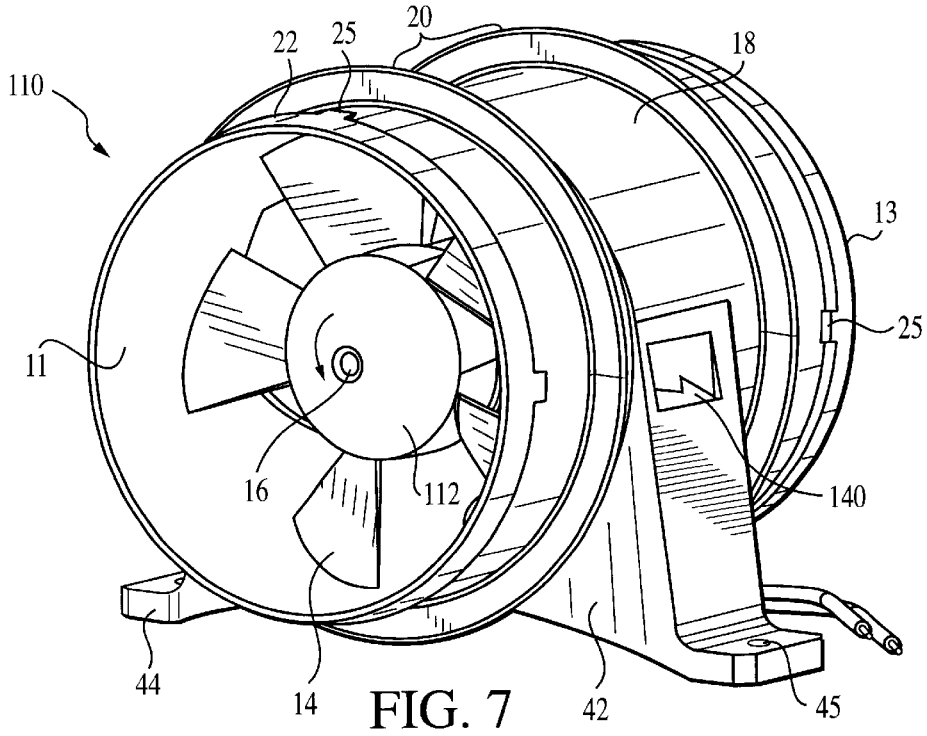
FIG. 7 is a perspective view of an axial-flow fan constructed in accordance with another embodiment of the invention.
Figure 8:
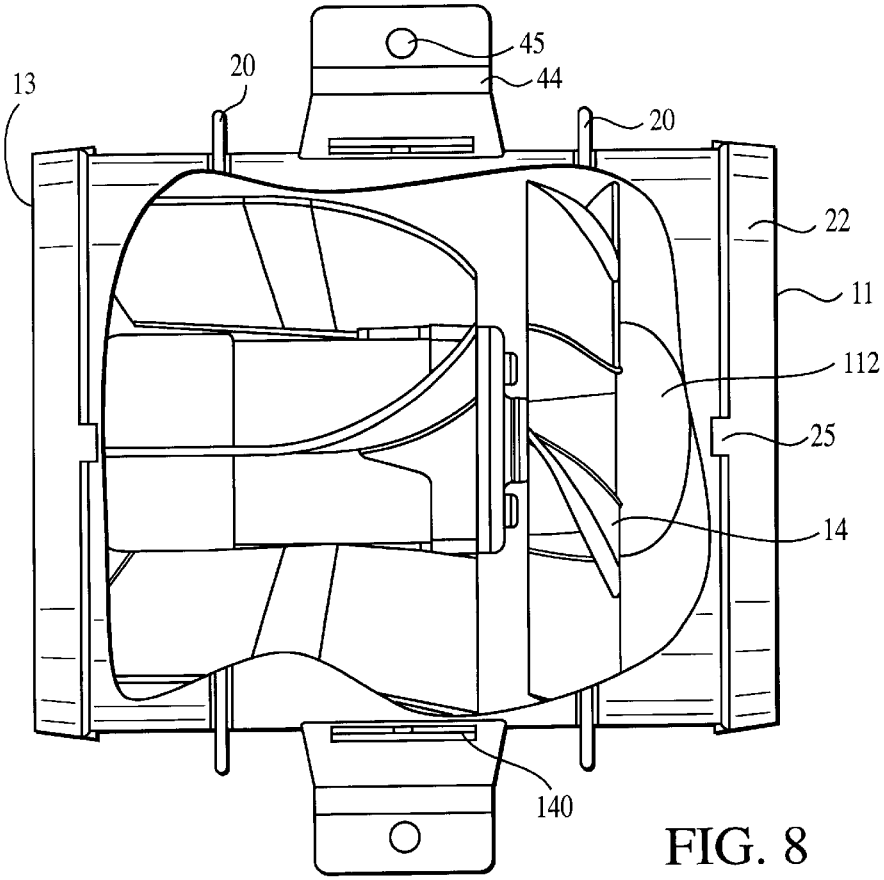
FIG. 8 is a partial cut-out view from the side of the fan of FIG. 7.

FIGS. 7 and 8 illustrate a second embodiment of the invention. Specifically, an axial-flow fan 110 is shown having a housing 18 extending between a first end 11 and a second end 13 and housing a fan apparatus including a fan wheel hub 112. A plurality of airfoils 114 extend from the hub 112. The chief difference between the hub 12 and the hub 112 is the diameter of the hub. While the hub 12 in a housing with an inside diameter of four inches is in the range of two and one-half inches and the hub 12 in a housing 18 with a diameter of three inches is about two inches, the hub 112 within a four inch diameter housing 18 and within a three inch diameter housing is in the range of, respectively, two and 1.65 inches. The diameter of the hub 112 approximates the diameter of the motor 46, and does not cause an impediment to naturally occurring air flow.

Certain Coast Guard regulations require that a boat cabin have a natural air source, i.e., a source of naturally circulated, and not circulated under power, air so that a predetermined amount of fresh air is circulated through the cabin. Most boat manufacturers build a single shaft into a cabin. Thus, for boats that must follow the Coast Guard regulations and that have only a single shaft into the cabin, the axial-flow fan 10, 110 must be placed in the shaft or a second shaft must be created to fit the fan.

If a second shaft is not to be created in the cabin, then the fan fitting within the single shaft must allow a certain predetermined amount of naturally circulated fresh air. In such an instance, the hub must be a smaller diameter to allow a greater amount of naturally circulating air in.

The base 42 includes a flow direction section 140 which provides an arrow to indicate the designed air-flow direction to installers of the fan 110.

The above description and drawings are only illustrative of preferred embodiments of the inventions, and are not intended to limit the inventions thereto. For example, while stiffening rings 20 have been described as the strengthening portions, other forms of strengthening portions may be used for providing circumferential support to the housing 18. Examples of other suitable strengthening portions may include axially directed elements which are positioned about the circumference of the housing or radially directed elements which extend around only a portion of the circumference of the housing. Any subject matter or modification thereof which comes within the spirit and scope of the following claims is to be considered part of the present inventions.

What is claimed as new and desired to be protected by Letters Patent of the United States is:

1. An axial-flow fan, comprising:

a plurality of airfoils extending from a rotatable fan wheel hub;

a motor engaged with said fan wheel hub through a shaft;

a housing into which said fan wheel hub and said motor are positioned, said housing having a circumference with a diameter and at least one strengthening portion positioned on the circumference of said housing, said strengthening portion inhibiting variation in the diameter of the circumference of the housing; and at least one tapered collar positioned at an end of said housing, said tapered collar decreasing in height over said diameter in a direction from in between the ends of said housing to the end of said housing at which said tapered collar is positioned, wherein each said tapered collar includes one or more collar tabs.

2. The fan of claim 1, wherein said strengthening portion comprises a plurality of axially directed elements.

3. The fan of claim 1, wherein said strengthening portion comprises at least one radially directed element.

4. The fan of claim 3, wherein said at least one radially directed element surrounds the circumference of said housing adjacent to said airfoils.

5. The fan of claim 4, wherein said at least one radially directed element comprises two stiffening rings.

6. The fan if claim 1, further comprising at least one straightening vane positioned with said housing.

7. The fan of claim 6, comprising a plurality of said straightening vanes extending from an inner surface of said housing.

8. The fan of claim 1, comprising two tapered collars, each being positioned at an end of said housing.

9. The fan of claim 1, wherein at least one end of said shaft is protected from moisture.

10. The fan of claim 9, wherein said fan wheel hub includes a sealing chamber having a shaft pocket for receiving one of the ends of said shaft.

11. The fan of claim 10, wherein another end of said shaft is enclosed within a protective boot.

12. The fan of claim 1, further comprising a base for supporting said housing.

13. The fan of claim 12, wherein said base includes a pair of feet.

14. The fan of claim 12, wherein said base is hollow.

15. An axial-flow fan, comprising:

a plurality of airfoils extending from a rotatable fan wheel hub;

a motor engaged with said fan wheel hub through a shaft;

a housing into which said fan wheel hub and said motor are positioned, said housing having a circumference with a diameter;

a plurality of straightening vanes extending from an inner surface of said housing;

at least one strengthening portion surrounding the circumference of said housing, said strengthening portion inhibiting variation in the diameter of the circumference of the housing; and a pair of tapered collars, each said collar being positioned at an end of said housing, each said tapered collar decreasing in height over said diameter in a direction from in between the ends of said housing to the end of said housing at which each said respective tapered collar is positioned, wherein each said tapered collar includes at least one collar tab.

16. The fan of claim 15, wherein said strengthening portion comprises a plurality of axially directed elements.

17. The fan of claim 15, wherein said strengthening portion comprises at least one radially directed element.

18. The fan of claim 17, wherein said at least one radially directed element surrounds the circumference of said housing adjacent to said airfoils.

19. The fan of claim 18, wherein said at least one radially directed element comprises two stiffening rings.

20. The fan of claim 15, wherein at least one end of said shaft is moisture protected.

21. The fan of claim 20, wherein said fan wheel hub includes a sealing chamber having a shaft pocket for receiving one of the ends of said shaft.

22. The fan of claim 21, wherein another end of said shaft is enclosed within a protective boot.

23. The fan of claim 15, further comprising a base for supporting said housing.

24. The fan of claim 23, wherein said base includes a pair of feet.

25. The fan of claim 23, wherein said base is hollow.

* * * * *